US006939249B2

(12) United States Patent
Sullivan

(10) Patent No.: US 6,939,249 B2
(45) **Date of Patent: *Sep. 6, 2005**

(54) GOLF BALL HAVING A HIGH MOMENT OF INERTIA

(75) Inventor: Michael J. Sullivan, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 33 days.

This patent is subject to a terminal disclaimer.

(21) Appl. No.: 10/789,289

(22) Filed: Feb. 27, 2004

(65) Prior Publication Data

US 2004/0171436 A1 Sep. 2, 2004

Related U.S. Application Data

(63) Continuation of application No. 10/082,577, filed on Feb. 25, 2002, now Pat. No. 6,743,123, which is a continuation-in-part of application No. 09/815,753, filed on Mar. 23, 2001, now Pat. No. 6,494,795.

(51) Int. Cl.[7] ..... A63B 37/04
(52) U.S. Cl. ..... 473/374; 473/373
(58) Field of Search ..... 473/373, 374, 473/367, 368

(56) References Cited

U.S. PATENT DOCUMENTS

| | | | | |
|---|---|---|---|---|
| 3,784,209 A | | 1/1974 | Berman et al. | 473/377 |
| 4,625,964 A | | 12/1986 | Yamada | 273/62 |
| 4,863,167 A | | 9/1989 | Matsuki et al. | 273/62 |
| 5,002,281 A | | 3/1991 | Nakahara et al. | 273/220 |
| 5,048,838 A | | 9/1991 | Chikaraishi et al. | 273/228 |
| 5,104,126 A | | 4/1992 | Gentiluomo | 273/228 |
| 5,273,286 A | | 12/1993 | Sun | 273/228 |
| 5,482,285 A | | 1/1996 | Yabuki et al. | 273/228 |
| 5,688,191 A | | 11/1997 | Cavallaro et al. | 473/373 |
| 5,713,801 A | | 2/1998 | Aoyama | 473/354 |
| 5,759,676 A | | 6/1998 | Cavallaro et al. | 428/215 |
| 5,779,561 A | | 7/1998 | Sullivan et al. | 473/373 |
| 5,783,293 A | | 7/1998 | Lammi | 428/212 |
| 5,803,831 A | * | 9/1998 | Sullivan et al. | 473/374 |
| 5,810,678 A | | 9/1998 | Cavallaro et al. | 473/373 |
| 5,813,923 A | | 9/1998 | Cavallaro et al. | 473/373 |
| 5,823,889 A | | 10/1998 | Aoyama | 473/374 |
| 5,824,746 A | | 10/1998 | Harris et al. | 525/196 |
| 5,833,553 A | | 11/1998 | Sullivan et al. | 473/374 |
| 5,873,796 A | | 2/1999 | Cavallaro et al. | 473/365 |
| 5,876,294 A | | 3/1999 | Yamagishi et al. | 473/374 |
| 5,885,172 A | | 3/1999 | Hebert et al. | 473/354 |
| 5,899,822 A | | 5/1999 | Yamagishi et al. | 473/374 |
| 5,935,022 A | | 8/1999 | Sugimoto et al. | 473/373 |
| 5,984,806 A | | 11/1999 | Sullivan et al. | 473/373 |
| 5,984,807 A | * | 11/1999 | Wai et al. | 473/376 |
| 6,015,356 A | | 1/2000 | Sullivan et al. | 473/373 |
| 6,025,442 A | | 2/2000 | Harris et al. | 525/221 |
| 6,048,279 A | | 4/2000 | Masutani | 473/372 |
| 6,057,403 A | | 5/2000 | Sullivan et al. | 525/221 |
| 6,068,561 A | | 5/2000 | Renard et al. | 473/364 |
| 6,095,932 A | | 8/2000 | Umezawa et al. | 473/356 |
| 6,102,815 A | | 8/2000 | Sutherland | 473/372 |
| 6,120,393 A | | 9/2000 | Sullivan et al. | 473/377 |
| 6,126,559 A | | 10/2000 | Sullivan et al. | 473/378 |
| 6,142,886 A | | 11/2000 | Sullivan et al. | 473/371 |

(Continued)

FOREIGN PATENT DOCUMENTS

| | | |
|---|---|---|
| WO | WO 99/52604 | 10/1999 |

*Primary Examiner*—Raeann Gorden

(57) ABSTRACT

A golf ball formed to have a low spin, high moment of inertia core assembly, which comprises a low specific gravity core and non-continuous high specific gravity intermediate layer. This core assembly is encased within a soft cover with Shore D hardness less than 65. The low specific gravity core is preferably made from a foamed polymer, and the non-continuous high specific gravity core is preferably a geodesic or polyhedron screen or a perforated shell.

19 Claims, 5 Drawing Sheets

U.S. PATENT DOCUMENTS

| | | | | | |
|---|---|---|---|---|---|
| 6,142,887 | A | * | 11/2000 | Sullivan et al. | 473/374 |
| 6,142,888 | A | | 11/2000 | Higuchi et al. | 473/374 |
| 6,149,536 | A | | 11/2000 | Sullivan et al. | 473/376 |
| 6,183,382 | B1 | | 2/2001 | Kim et al. | 473/374 |
| 6,193,618 | B1 | | 2/2001 | Sullivan et al. | 473/373 |
| 6,219,453 | B1 | | 4/2001 | Goldberg | 382/229 |
| 6,267,692 | B1 | | 7/2001 | Higuchi et al. | 473/365 |
| 6,267,694 | B1 | | 7/2001 | Higuchi et al. | 473/374 |
| 6,309,312 | B1 | | 10/2001 | Sullivan et al. | 473/375 |
| 6,309,314 | B1 | | 10/2001 | Sullivan et al. | 473/378 |
| 6,520,871 | B1 | * | 2/2003 | Sullivan et al. | 473/374 |
| 6,743,123 | B2 | * | 6/2004 | Sullivan | 473/376 |
| 2001/0019969 | A1 | | 9/2001 | Binette et al. | 473/354 |
| 2002/0013185 | A1 | | 1/2002 | Sullivan et al. | 473/373 |
| 2002/0034989 | A1 | | 3/2002 | Sullivan et al. | 473/373 |

* cited by examiner

GOLF BALL HAVING A HIGH MOMENT OF INERTIA

STATEMENT OF RELATED APPLICATION

This patent application is a continuation of U.S. application Ser. No. 10/082,577 entitled "GOLF BALL HAVING A HIGH MOMENT OF INERTIA AND LOW DRIVER SPIN RATE", file on Feb. 25, 2002, now U.S. Pat. No. 6,743,123 which is a continuation-in-part of U.S. patent application Ser. No. 09/815,753 entitled "GOLF BALL AND A METHOD FOR CONTROLLING THE SPIN RATE OF SAME", filed on Mar. 23, 2001, now U.S. Pat. No. 6,494,795. The parent applications are incorporated herein by reference in their entirety.

FIELD OF THE INVENTION

The present invention relates to golf balls and more particularly, the invention is directed to a progressive performance golf ball having a high moment of inertia subassembly.

BACKGROUND OF THE INVENTION

The spin rate of golf balls is the end result of many variables, one of which is the distribution of the density or specific gravity within the ball. Spin rate is an important characteristic of golf balls for both skilled and recreational golfers. High spin rate allows the more skilled players, such as PGA professionals and low handicapped players, to maximize control of the golf ball. A high spin rate golf ball is advantageous for an approach shot to the green. The ability to produce and control back spin to stop the ball on the green and side spin to draw or fade the ball substantially improves the player's control over the ball. Hence, the more skilled players generally prefer a golf ball that exhibits high spin rate.

On the other hand, recreational players who cannot intentionally control the spin of the ball generally do not prefer a high spin rate golf ball. For these players, slicing and hooking are the more immediate obstacles. When a club head strikes a ball, an unintentional side spin is often imparted to the ball, which sends the ball off its intended course. The side spin reduces the player's control over the ball, as well as the distance the ball will travel. A golf ball that spins less tends not to drift off-line erratically if the shot is not hit squarely off the club face. The low spin ball will not cure the hook or the slice, but will reduce the adverse effects of the side spin. Hence, recreational players prefer a golf ball that exhibits low spin rate.

Reallocating the density or specific gravity of the various layers or mantles in the ball is an important means of controlling the spin rate of golf balls. In some instances, the weight from the outer portions of the ball is redistributed to the center of the ball to decrease the moment of inertia thereby increasing the spin rate. For example, U.S. Pat. No. 4,625,964 discloses a golf ball with a reduced moment of inertia having a core with specific gravity of at least 1.50 and a diameter of less than 32 mm and an intermediate layer of lower specific gravity between the core and the cover. U.S. Pat. No. 5,104,126 discloses a ball with a dense inner core having a specific gravity of at least 1.25 encapsulated by a lower density syntactic foam composition. U.S. Pat. No. 5,048,838 discloses another golf ball with a dense inner core having a diameter in the range of 15–25 mm with a specific gravity of 1.2 to 4.0 and an outer layer with a specific gravity of 0.1 to 3.0 less than the specific gravity of the inner core.

U.S. Pat. No. 5,482,285 discloses another golf ball with reduced moment of inertia by reducing the specific gravity of an outer core to 0.2 to 1.0.

In other instances, the weight from the inner portion of the ball is redistributed outward to increase the moment of inertia thereby decreasing the spin rate. U.S. Pat. No. 6,120,393 discloses a golf ball with a hollow inner core with one or more resilient outer layers, thereby giving the ball a soft core, and a hard cover. U.S. Pat. No. 6,142,887 discloses a high moment of inertia golf ball comprising one or more mantle layers made from metals, ceramic or composite materials, and a polymeric spherical substrate disposed inwardly from the mantle layers. U.S. Pat. No. 705,359 discloses a golf ball having a perforated metal shell positioned immediately interior to the outer cover. U.S. Pat. No. 5,984,806 discloses perimeter weighted golf ball, wherein the weights are visible on the surface of the golf ball. On the other hand, the weight of the ball can also be distributed outward by using a hollow, cellular or other low specific gravity core materials, as disclosed in U.S. Pat. Nos. 6,193,618 B1 and 5,823,889, among others.

These and other references disclose specific examples of high and low spin rate balls, but none of these references employ the selective variation of the ball's moment of inertia to create a progressive performance ball, which exhibits low spin when struck by a driver and high spin when struck by a wedge. Hence, there remains a need in the art for an improved progressive performance golf ball.

SUMMARY OF THE INVENTION

The present invention is directed to a golf ball with a controlled moment of inertia.

The present invention is also directed to a progressive performance golf ball with a controlled moment of inertia.

The present invention is preferably directed to a ball comprising an intermediate layer covering a core and a cover encasing the intermediate layer. The intermediate layer preferably comprises a non-continuous layer having a specific gravity of greater than 1.2 and a thickness from about 0.025 mm to 1.27 mm. The intermediate layer is preferably positioned at a distance radially outside of the centroid radius. The intermediate layer is preferably positioned at a distance ranging from about 0.76 mm to 2.8 mm from the outer surface of the golf ball.

In accordance to another aspect of the invention, the specific gravity of the non-continuous layer is greater than 1.5, more preferably greater than 1.8 and even more preferably greater than 2.0. The thickness of the non-continuous layer may also range from 0.127 mm to 0.76 mm, and more preferably from 0.25 mm to 0.5 mm.

In accordance to another aspect of the present invention, the intermediate layer may also comprise a thin dense layer having a specific gravity of greater than 1.2 and positioned proximate to the non-continuous layer. Additionally, the intermediate layer may also comprise a second non-continuous layer.

In accordance to another aspect of the invention, the golf ball comprises an intermediate member and a non-continuous member, and the intermediate member is located proximate to the non-continuous member.

The core preferably has a specific gravity of less than 1.1, and more preferably less than 1.0, and even more preferably less than 0.9. Additionally, the core is preferably foamed to reduce its specific gravity. Alternatively, the core may include fillers, hollow spheres or the like to reduce the specific gravity. The cover preferably has a hardness of less than 65 Shore D, more preferably between about 30 and about 60, more preferably between about 35 and about 50 and most preferably between about 40 and about 45. The cover is preferably made from a thermoset or thermoplastic polyurethane, an ionomer, a metallocene or other single site catalyzed polymer. The cover preferably has a thickness of less than 1.27 mm, more preferably between about 0.51 mm and about 1.02 mm, and most preferably about 0.76 mm.

Preferably, the non-continuous layer covers at least 10% of the surface area of an adjacent layer, more preferably at least about 25% and most preferably at least about 50%.

The present invention is also preferably directed to a ball comprising a core, an intermediate layer and a cover wherein the weight or mass of the ball is allocated outwardly to form a high moment of inertia and wherein the cover is made from a soft material having a hardness of 65 (shore D) or less. The moment of inertia of the ball is preferably greater than 0.46 oz·inch$^2$, more preferably 0.50 oz·inch$^2$, and most preferably 0.575 oz·inch$^2$. Similar to the embodiment discussed above, the intermediate layer may comprise a non-continuous layer having a high specific gravity. It may also comprise a thin dense layer and/or a second non-continuous layer. The core preferably has a low specific gravity and is preferably foamed. The specific gravities, locations, thicknesses, hardness and surface areas discussed above relating to the individual layers of the inventive golf ball are equally applicable to this embodiment.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
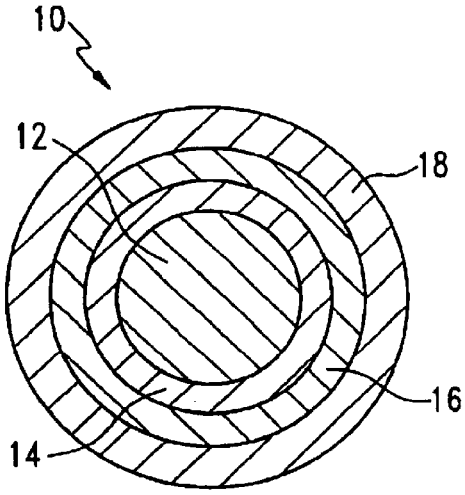
FIG. 1 is a cross-sectional view of a golf ball 10 having an inner core 12, at least two intermediate layers 14, 16 and an outer cover 18 in accordance to an embodiment of the present invention.
Figure 2:
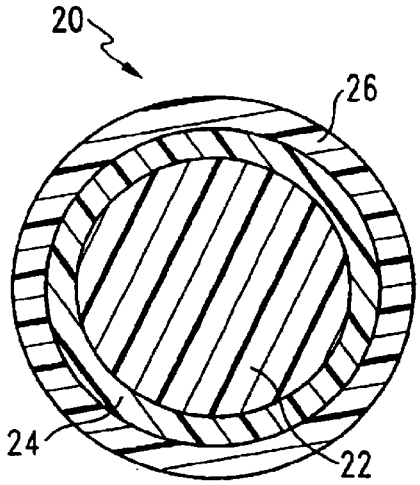
FIG. 2 is a cross-sectional view of a golf ball 20 having inner core 22, at least one intermediate layer 24 and an outer cover 26 in accordance to another embodiment of the present invention.
Figure 3:
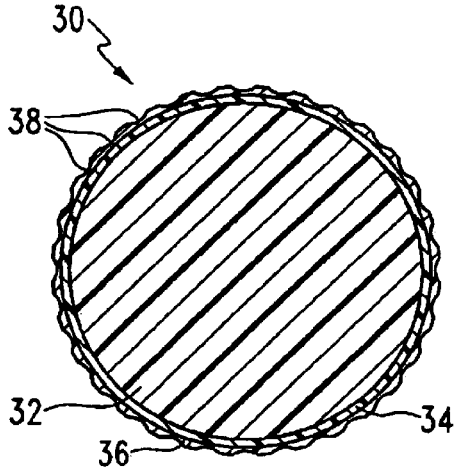
FIG. 3 is a cross-sectional view of a golf ball 30 having inner core 32, a thin intermediate layer 34 and an outer cover 36.

Referring generally to FIGS. 1, 2 and 3 where golf balls 10, 20 and 30 are shown, it is well known that the total weight of the ball has to conform to the weight limit set by the United States Golf Association ("USGA"). Distributing the weight or mass of the ball either toward the center of the ball or toward the outer surface of the ball changes the dynamic characteristics of the ball at impact and in flight. Specifically, if the density is shifted or distributed toward the center of the ball, the moment of inertia is reduced, and the initial spin rate of the ball as it leaves the golf club would increase due to lower resistance from the ball's moment of inertia. Conversely, if the density is shifted or distributed toward the outer cover, the moment of inertia is increased, and the initial spin rate of the ball as it leaves the golf club would decrease due to the higher resistance from the ball's moment of inertia. The radial distance from the center of the ball or from the outer cover, where moment of inertia switches from being increased and to being decreased as a result of the redistribution of weight or mass density, is an important factor in golf ball design.

In accordance to one aspect of the present invention, this radial distance, hereinafter referred to as the centroid radius, is provided. When more of the ball's mass or weight is reallocated to the volume of the ball from the center to the centroid radius, the moment of inertia is decreased, thereby producing a high spin ball. Hereafter, such a ball is referred as a low moment of inertia ball. When more of the ball's mass or weight is reallocated to the volume between the centroid radius and the outer cover, the moment of inertia is increased thereby producing a low spin ball. Hereafter, such a ball is referred as a high moment of inertia ball.

The centroid radius can be determined by following the steps below:

(a) Setting $R_o$ to half of the 1.68-inch diameter for an average size ball, where $R_o$ is the outer radius of the ball.

(b) Setting the weight of the ball to the USGA legal weight of 1.62 oz.

(c) Determining the moment of inertia of a ball with evenly distributed density prior to any weight distribution.

The moment of inertia is represented by $(2/5)(M_t)(R_o^2)$, where Mt is the total mass or weight of the ball. For the purpose of this invention, mass and weight can be used interchangeably. The formula for the moment of inertia for a sphere through any diameter is given in the CRC Standard Mathematical Tables, 24$^{the}$ Edition, 1976 at 20 (hereinafter CRC reference). The moment of inertia of such a ball is 0.4572 oz-in$^2$. This will be the baseline moment of inertia value.

(d) Taking a predetermined amount of weight uniformly from the ball and reallocating this predetermined weight in the form of a thin shell to a location near the center of the ball and calculating the new moment of inertia of the weight redistributed ball.

This moment of inertia is the sum of the inertia of the ball with the reduced weight plus the moment of inertia contributed by the thin shell. This new moment of inertia is expressed as $(2/5)(M_r)(R_o^2)+(2/3)(M_s)(R_s^2$where Mr is the reduced weight of the ball; $M_s$ is the weight of the thin shell; and Rs is the radius of the thin shell measured from the center of the ball. Also, $M_t=M_r+M_s$. The formula of the moment of inertia from a thin shell is also given in the CRC reference.

(e) Comparing the new moment of inertia determined in step (d) to the baseline inertia value determined in step (c) to determine whether the moment of inertia has increased or decreased due to the reallocation of weight, i.e., subtracting the baseline inertia from the new inertia.

(f) Repeating steps (d) and (e) with the same predetermined weight incrementally moving away from the center of the ball until the predetermined weight reaches the outer surface of the ball.

(g) Determining the centroid radius as the radial location where the moment of inertia changes from increasing to decreasing.

(h) Repeating steps (d), (e), (f) and (g) with different predetermined weights and confirming that the centroid radius is the same for each predetermined weight.

In a preferred embodiment of the present invention, the predetermined weight is initially set at a very small weight, e.g., 0.01 oz, and the location of the thin shell is initially placed at 0.01 inch radially from the center of the ball. The 0.01 oz thin shell is then moved radially and incrementally away from the center. The results are reported in the following table:

TABLE 1

| 0.01-oz Weight | | | | |
|---|---|---|---|---|
| Radius (inch) | Inertia (reduced) | Inertia (0.01 shell) | Inertia (new) | Changes in Inertia |
| 0.010 | 0.4544 | 0.000001 | 0.4544 | −0.0028 |
| 0.020 | 0.4544 | 0.000003 | 0.4544 | −0.0028 |
| 0.025 | 0.4544 | 0.000004 | 0.4544 | −0.0028 |
| 0.050 | 0.4544 | 0.000017 | 0.4544 | −0.0028 |
| 0.100 | 0.4544 | 0.000067 | 0.4545 | −0.0027 |
| 0.150 | 0.4544 | 0.000150 | 0.4546 | −0.0026 |
| 0.200 | 0.4544 | 0.000267 | 0.4547 | −0.0025 |
| 0.250 | 0.4544 | 0.000417 | 0.4548 | −0.0024 |
| 0.300 | 0.4544 | 0.000600 | 0.4550 | −0.0022 |
| 0.350 | 0.4544 | 0.000817 | 0.4552 | −0.0020 |
| 0.400 | 0.4544 | 0.001067 | 0.4555 | −0.0017 |
| 0.450 | 0.4544 | 0.001350 | 0.4558 | −0.0014 |
| 0.500 | 0.4544 | 0.001667 | 0.4561 | −0.0011 |
| 0.550 | 0.4544 | 0.002017 | 0.4564 | −0.0008 |
| 0.600 | 0.4544 | 0.002400 | 0.4568 | −0.0004 |
| 0.650 | 0.4544 | 0.002817 | 0.4572 | 0.0000 |
| 0.700 | 0.4544 | 0.003267 | 0.4577 | 0.0005 |
| 0.750 | 0.4544 | 0.003750 | 0.4582 | 0.0010 |
| 0.800 | 0.4544 | 0.004267 | 0.4587 | 0.0015 |
| 0.840 | 0.4544 | 0.004704 | 0.4591 | 0.0019 |

The results show that for a 1.62-oz ball with a 1.68-inch diameter, the centroid radius is approximately at 0.65 inch (16.5 mm) radially away from the center of the ball or approximately 0.19 inch (4.83 mm) radially inward from the outer surface. In other words, when the reallocated weight is positioned at a radial distance about 0.65 inch, the new moment of inertia of the ball is the same as the baseline moment of inertia of a uniform density ball. To ensure that the preferred method of determining the centroid radius discussed above is a correct one, the same calculation was repeated for predetermined weights of 0.20 oz, 0.405 oz (¼ of the total weight of the ball), 0.81 oz (½ of the total weight) and 1.61 oz (practically all of the weight). The results are reported in the following tables:

TABLE 2

| 0.20-oz Weight | | | | |
|---|---|---|---|---|
| Radius (inch) | Inertia (reduced) | Inertia (0.20 shell) | Inertia (new) | Changes in Inertia |
| 0.010 | 0.4008 | 0.000013 | 0.4008 | −0.0564 |
| 0.020 | 0.4008 | 0.000053 | 0.4008 | −0.0564 |
| 0.025 | 0.4008 | 0.000083 | 0.4009 | −0.0563 |
| 0.050 | 0.4008 | 0.000333 | 0.4011 | −0.0561 |

TABLE 2-continued

| 0.20-oz Weight | | | | |
|---|---|---|---|---|
| Radius (inch) | Inertia (reduced) | Inertia (0.20 shell) | Inertia (new) | Changes in Inertia |
| 0.100 | 0.4008 | 0.001333 | 0.4021 | −0.0551 |
| 0.150 | 0.4008 | 0.003000 | 0.4038 | −0.0534 |
| 0.200 | 0.4008 | 0.005333 | 0.4061 | −0.0511 |
| 0.250 | 0.4008 | 0.008333 | 0.4091 | −0.0481 |
| 0.300 | 0.4008 | 0.012000 | 0.4128 | −0.0444 |
| 0.350 | 0.4008 | 0.016333 | 0.4171 | −0.0401 |
| 0.400 | 0.4008 | 0.021333 | 0.4221 | −0.0351 |
| 0.450 | 0.4008 | 0.027000 | 0.4278 | −0.0294 |
| 0.500 | 0.4008 | 0.033333 | 0.4341 | −0.0231 |
| 0.550 | 0.4008 | 0.040333 | 0.4411 | −0.0161 |
| 0.600 | 0.4008 | 0.048000 | 0.4488 | −0.0084 |
| 0.650 | 0.4008 | 0.056333 | 0.4571 | −0.0001 |
| 0.700 | 0.4008 | 0.065333 | 0.4661 | 0.0089 |
| 0.750 | 0.4008 | 0.075000 | 0.4758 | 0.0186 |
| 0.800 | 0.4008 | 0.085333 | 0.4861 | 0.0289 |
| 0.840 | 0.4008 | 0.094080 | 0.4949 | 0.0377 |

TABLE 3

| 0.405-oz Weight | | | | |
|---|---|---|---|---|
| Radius (inch) | Inertia (reduced) | Inertia (0.405 shell) | Inertia (new) | Changes in Inertia |
| 0.010 | 0.3429 | 0.000027 | 0.3429 | −0.1143 |
| 0.020 | 0.3429 | 0.000108 | 0.3430 | −0.1142 |
| 0.025 | 0.3429 | 0.000169 | 0.3431 | −0.1141 |
| 0.050 | 0.3429 | 0.000675 | 0.3436 | −0.1136 |
| 0.100 | 0.3429 | 0.002700 | 0.3456 | −0.1116 |
| 0.150 | 0.3429 | 0.006075 | 0.3490 | −0.1082 |
| 0.200 | 0.3429 | 0.010800 | 0.3537 | −0.1035 |
| 0.250 | 0.3429 | 0.016875 | 0.3598 | −0.0974 |
| 0.300 | 0.3429 | 0.024300 | 0.3672 | −0.0900 |
| 0.350 | 0.3429 | 0.033075 | 0.3760 | −0.0812 |
| 0.400 | 0.3429 | 0.043200 | 0.3861 | −0.0711 |
| 0.450 | 0.3429 | 0.054675 | 0.3976 | −0.0596 |
| 0.500 | 0.3429 | 0.067500 | 0.4104 | −0.0468 |
| 0.550 | 0.3429 | 0.081675 | 0.4246 | −0.0326 |
| 0.600 | 0.3429 | 0.097200 | 0.4401 | −0.0171 |
| 0.650 | 0.3429 | 0.114075 | 0.4570 | −0.0002 |
| 0.700 | 0.3429 | 0.132300 | 0.4752 | 0.0180 |
| 0.750 | 0.3429 | 0.151875 | 0.4948 | 0.0376 |
| 0.800 | 0.3429 | 0.172800 | 0.5157 | 0.0585 |
| 0.840 | 0.3429 | 0.190512 | 0.5334 | 0.0762 |

TABLE 4

| 0.81-oz Weight | | | | |
|---|---|---|---|---|
| Radius (inch) | Inertia (reduced) | Inertia (0.81 shell) | Inertia (new) | Changes in Inertia |
| 0.010 | 0.2286 | 0.000054 | 0.2287 | −0.2285 |
| 0.020 | 0.2286 | 0.000216 | 0.2288 | −0.2284 |
| 0.025 | 0.2286 | 0.000338 | 0.2290 | −0.2282 |
| 0.050 | 0.2286 | 0.001350 | 0.2300 | −0.2272 |
| 0.100 | 0.2286 | 0.005400 | 0.2340 | −0.2232 |
| 0.150 | 0.2286 | 0.012150 | 0.2408 | −0.2164 |
| 0.200 | 0.2286 | 0.021600 | 0.2502 | −0.2070 |
| 0.250 | 0.2286 | 0.033750 | 0.2624 | −0.1948 |
| 0.300 | 0.2286 | 0.048600 | 0.2772 | −0.1800 |
| 0.350 | 0.2286 | 0.066150 | 0.2948 | −0.1624 |
| 0.400 | 0.2286 | 0.086400 | 0.3150 | −0.1422 |
| 0.450 | 0.2286 | 0.109350 | 0.3380 | −0.1192 |
| 0.500 | 0.2286 | 0.135000 | 0.3636 | −0.0936 |
| 0.550 | 0.2286 | 0.163350 | 0.3920 | −0.0652 |
| 0.600 | 0.2286 | 0.194400 | 0.4230 | −0.0342 |
| 0.650 | 0.2286 | 0.228150 | 0.4568 | −0.0004 |
| 0.700 | 0.2286 | 0.264600 | 0.4932 | 0.0360 |

TABLE 4-continued

| 0.81-oz Weight | | | | |
|---|---|---|---|---|
| Radius (inch) | Inertia (reduced) | Inertia (0.81 shell) | Inertia (new) | Changes in Inertia |
| 0.750 | 0.2286 | 0.303750 | 0.5324 | 0.0752 |
| 0.800 | 0.2286 | 0.345600 | 0.5742 | 0.1170 |
| 0.840 | 0.2286 | 0.381024 | 0.6096 | 0.1524 |

TABLE 5

| 1.61-oz Weight | | | | |
|---|---|---|---|---|
| Radius (inch) | Inertia (reduced) | Inertia (1.61 shell) | Inertia (new) | Changes in Inertia |
| 0.010 | 0.0028 | 0.000107 | 0.0029 | −0.4543 |
| 0.020 | 0.0028 | 0.000429 | 0.0033 | −0.4539 |
| 0.025 | 0.0028 | 0.000671 | 0.0035 | −0.4537 |
| 0.050 | 0.0028 | 0.002683 | 0.0055 | −0.4517 |
| 0.100 | 0.0028 | 0.010733 | 0.0136 | −0.4436 |
| 0.150 | 0.0028 | 0.024150 | 0.0270 | −0.4302 |
| 0.200 | 0.0028 | 0.042933 | 0.0458 | −0.4114 |
| 0.250 | 0.0028 | 0.067083 | 0.0699 | −0.3873 |
| 0.300 | 0.0028 | 0.096600 | 0.0994 | −0.3578 |
| 0.350 | 0.0028 | 0.131483 | 0.1343 | −0.3229 |
| 0.400 | 0.0028 | 0.171733 | 0.1746 | −0.2826 |
| 0.450 | 0.0028 | 0.217350 | 0.2202 | −0.2370 |
| 0.500 | 0.0028 | 0.268333 | 0.2712 | −0.1860 |
| 0.550 | 0.0028 | 0.324683 | 0.3275 | −0.1297 |
| 0.600 | 0.0028 | 0.386400 | 0.3892 | −0.0680 |
| 0.650 | 0.0028 | 0.453483 | 0.4563 | −0.0009 |
| 0.700 | 0.0028 | 0.525933 | 0.5288 | 0.0716 |
| 0.750 | 0.0028 | 0.603750 | 0.6066 | 0.1494 |
| 0.800 | 0.0028 | 0.686933 | 0.6898 | 0.2326 |
| 0.840 | 0.0028 | 0.757344 | 0.7602 | 0.3030 |

Figure 8:
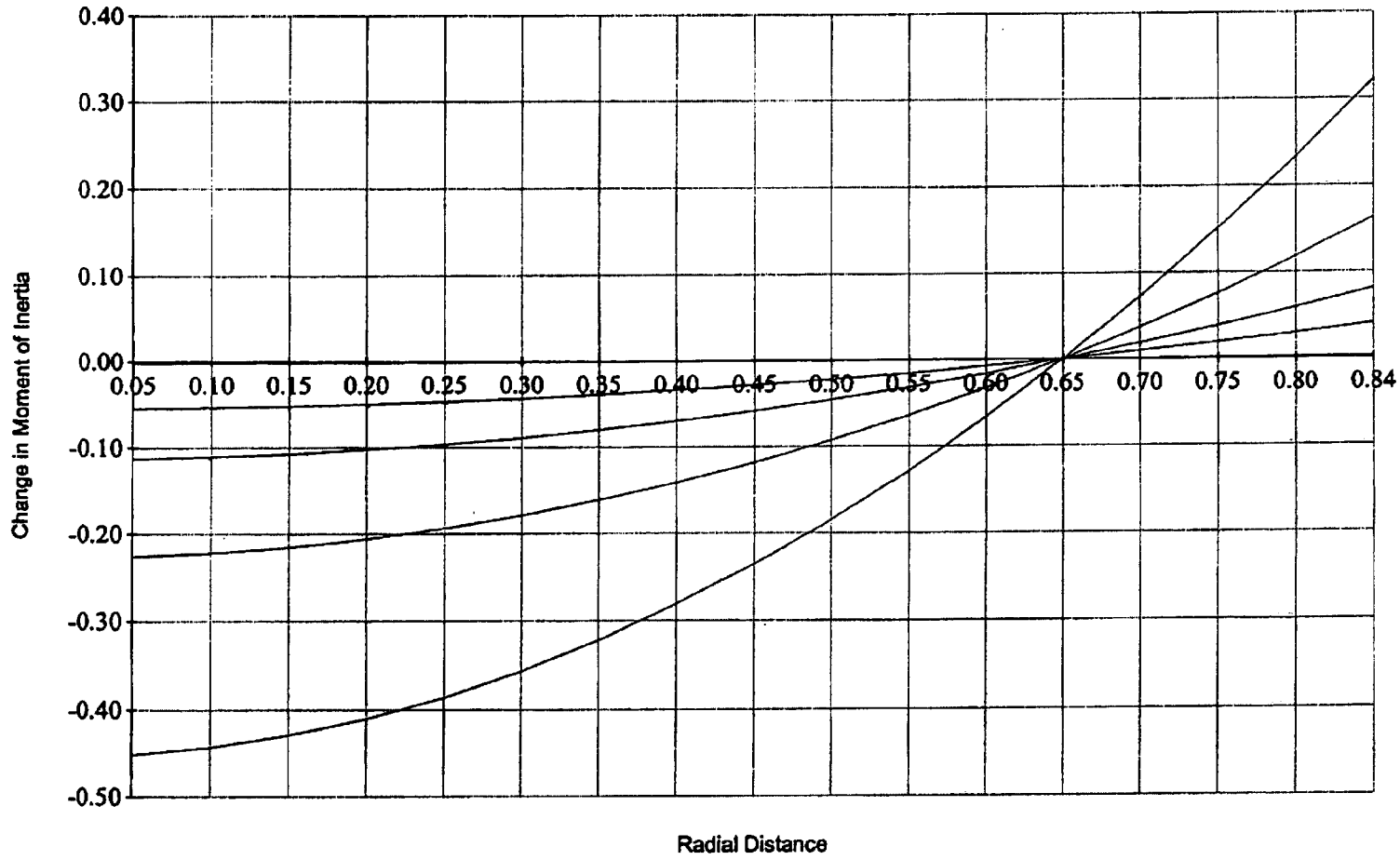
FIG. 8 is a graph showing the determination of the centroid radius in accordance to an aspect of the present invention.

In each case, the centroid radius is located at the same radial distance, i.e., at approximately 0.65 inch radially from the center of a ball weighing 1.62 oz and with a diameter of 1.68 inches. A graph of the "Changes in Inertia" value versus radial distance for each predetermined weight, shown in FIG. 8, where the x-axis is the radial distance and the y-axis is the "Changes in Inertia," confirms that the centroid radius is located approximately 0.65 inch radially away from the center of the ball or 0.19 inch from the outer surface of the ball.

Ball 10, as shown in FIG. 1, comprises an inner core 12, at least two intermediate layers 14, 16 and a cover 18. Ball 20, as shown in FIG. 2, has an inner core 22 at least one intermediate layer 24 and a cover 26. Ball 30, as shown in FIG. 3, has an inner core 32, a relatively thin intermediate layer 34 and a cover 36. Cover 36 also has a plurality of dimples 38 defined thereon. Covers 18 and 26 may also have dimples. Intermediate layers 14, 16, 24 and 34 may be part of the core or a part of the cover.

In accordance to one aspect of the invention, ball 20 is a high moment of inertia ball comprising a low specific gravity inner core 22, encompassed by a high specific gravity intermediate layer 24. At least a portion of inner core 22 is made with a cellular material, a density reducing filler or is otherwise reduced in density, e.g., with foam. As used herein, the term low specific gravity layer means a layer or a portion of the layer that has its specific gravity reduced by a density reducing filler, foam or other methods. Inner core 22 and layer 24 are further encased within a cover 26. Preferably, the cover does not have a density adjusting element, except for pigments, colorants, stabilizers and other additives employed for reasons other than adjusting the density of the cover. The high density or high specific gravity layer 24 is positioned radially outward relative to the centroid radius. Ball 20, therefore, advantageously has a high moment of rotational inertia and low initial spin rates to reduce slicing and hooking when hit with a driver club.

The intermediate layer 24 preferably has the highest specific gravity of all the layers in ball 20. Preferably, the specific gravity of layer 24 is greater than 1.8. The term specific gravity, as used herein, has its ordinary and customary meaning, i.e., the ratio of the density of a substance to the density of water at 4° C., and the density of water at this temperature is 1 g/cm$^3$. More preferably, the specific gravity of layer 24 is greater than 2.0 and most preferably, the specific gravity of layer 24 is greater than 2.5. The specific gravity can be as high as 5.0, 10.0 or more. Intermediate layer 24 may be made from a high density metal or from metal powder encased in a polymeric binder. High density metals such as steel, tungsten, lead, brass, bronze, copper, nickel, molybdenum, or alloys may be used. Layer 24 may comprise multiple discrete layers of various metals or alloys. Alternatively, a loaded thin film or "pre-preg" or a "densified loaded film," as described in U.S. Pat. No. 6,010,411 related to golf clubs, may be used as the thin film layer in a compression molded or otherwise in a laminated form applied inside the cover layer 26. The "pre-preg" disclosed in the '411 patent may be used with or without the fiber reinforcement, so long as the preferred specific gravity and preferred thickness levels are satisfied. The loaded film comprises a staged resin film that has a densifier or weighing agent, preferably copper, iron or tungsten powder evenly distributed therein. The resin may be partially cured such that the loaded film forms a malleable sheet that may be cut to desired size and then applied to the outside of the core or inside of the cover. Such films are available from the Cytec of Anaheim, Calif. or Bryte of San Jose, Calif.

Figure 4A:
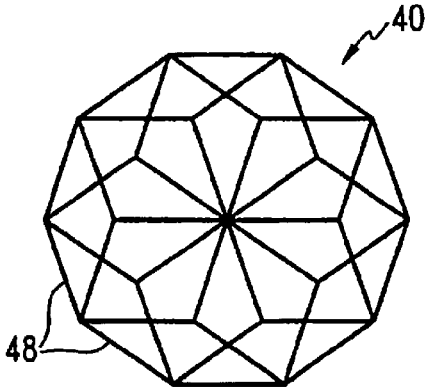
FIGS. 4A–4D are front views of some of the preferred embodiments of the non-continuous high specific gravity layer in accordance to the present invention.
Figure 4B:
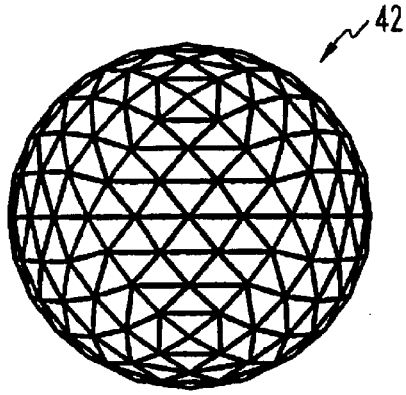
Figure 4C:
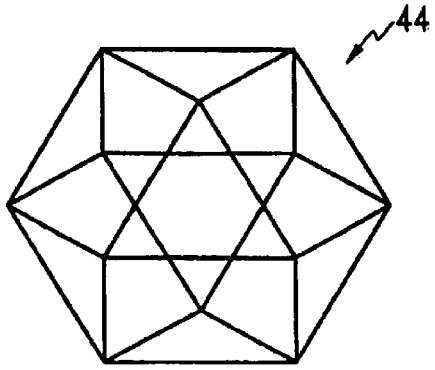
Figure 4D:
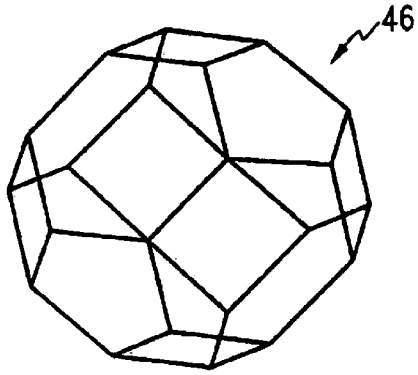
Figure 5A:
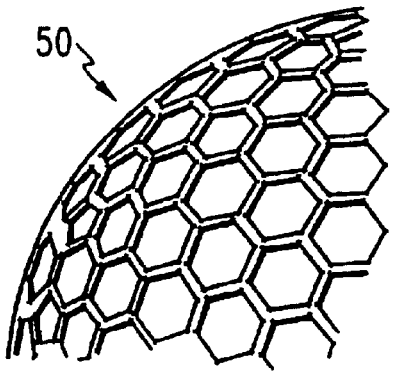
FIGS. 5A and 5B are front views of additional preferred embodiments in accordance to the present invention.
Figure 5B:
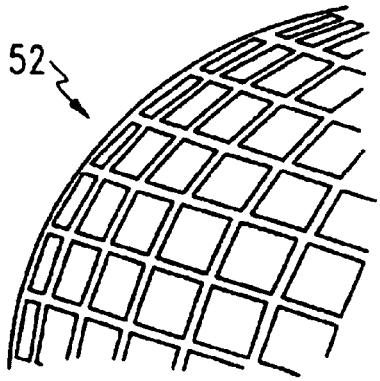

Preferably, intermediate layer 24 is also a non-continuous layer, i.e., it does not encase core 22 completely, and portions of core 22 directly contact cover 26. Additionally, intermediate layer 24 may comprise a non-continuous layer and a high specific gravity layer. In accordance to an aspect of the invention, non-continuous intermediate layer 24 may be a screen, a lattice, a scrim, a geodesic pattern or a perforated spherical shell. The perforations may be round, oval, square, any curved figure or any polygon. The perforations may be arranged in a pattern or in random. The non-continuous layer may also be arranged in a random pattern, such as the patterns achieved by a non-woven or sputtering application. For example, FIG. 4A shows an exemplary wire-frame geodesic screen 40 comprising a plurality of diamonds. Examples of other suitable screens include screen 42, which comprises a plurality of triangles shown in FIG. 4B, screen 44, which comprises a plurality of squares and equilateral triangles shown in FIG. 4C, and screen 46, which comprises a plurality of hexagons and squares shown in FIG. 4D. Examples of perforated spherical shells 50 and 52 are shown in FIGS. 5A and 5B. Preferably, the non-continuous layer 14 covers at least 10% of the core 12 or the sub-assembly encased by layer 14; more preferably the non-continuous layer covers between about 25% to about 90%, more preferably between about 40% and about 80%.

Figure 6:
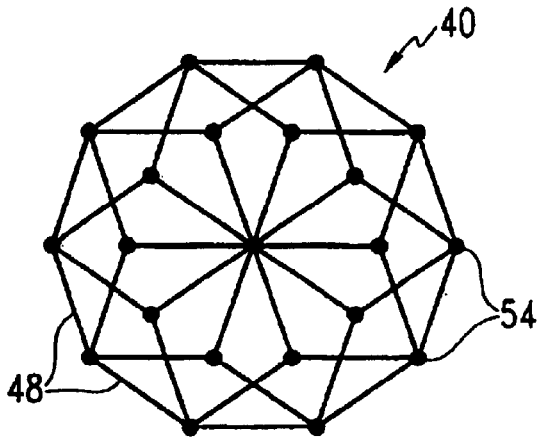
FIG. 6 is a front view of an alternative embodiment of FIG. 4A.
Figure 7A:
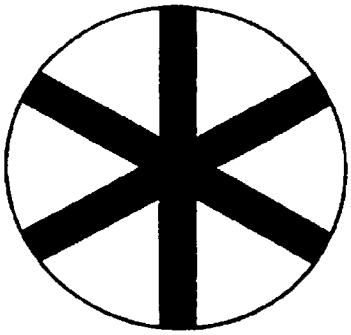
FIG. 7A–7D are front views of additional alternative embodiments in accordance to the present invention.
Figure 7B:
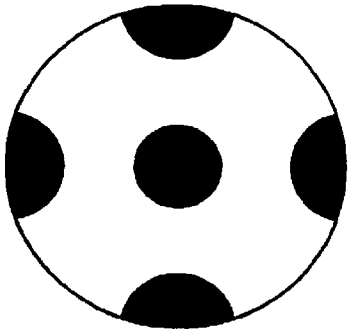
Figure 7C:
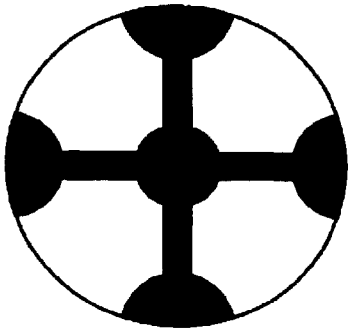
Figure 7D:
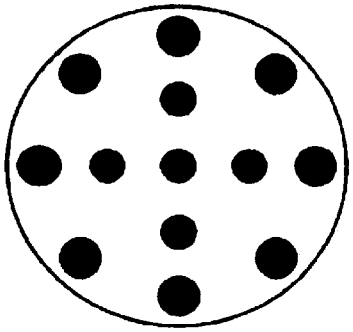

Screens 40, 42, 44 and 46 and perforated shells 50 and 52 are shown herein for illustration purpose only and the invention is not so limited. The weight of the screens are preferably carried by the segments 48 so that the weight is evenly distributed throughout layer 24. Alternatively, some of the weights can be allocated to nodes 54 of the screen as shown in FIG. 6. Other embodiments of non-continuous shell 24 are shown in FIGS. 7A–7D. The non-continuous shell can be a plurality of intersecting bands shown in FIG. 7A, or as a plurality of islands shown in FIG. 7B. These islands may be connected to each other as shown in FIG. 7C. Alternatively, the non-continuous layer 24 may comprise discrete shapes of varying sizes as shown in FIG. 7D.

Segments 48 are preferably made from a durable material such as metal, flexible or rigid plastics, high strength organic or inorganic fibers, any material that has a high Young's modulus, or blends or composites thereof. Suitable plastics or polymers include, but not limited to, one or more of partially or fully neutralized ionomers including those neutralized by a metal ion source wherein the metal ion is the salt of an organic acid, polyolefins including polyethylene, polypropylene, polybutylene and copolymers thereof including polyethylene acrylic acid or methacrylic acid copolymers, or a terpolymer of ethylene, a softening acrylate class ester such as methyl acrylate, n-butyl-acrylate or iso-butyl-acrylate, and a carboxylic acid such as acrylic acid or methacrylic acid (e.g., terpolymers including polyethylene-methacrylic acid-n or iso-butyl acrylate and polyethylene-acrylic acid-methyl acrylate, polyethylene ethyl or methyl acrylate, polyethylene vinyl acetate, polyethylene glycidyl alkyl acrylates). Suitable polymers also include metallocene catalyzed polyolefins, polyesters, polyamides, non-ionomeric thermoplastic elastomers, copolyether-esters, copolyether-amides, thermoplastic or thermosetting polyurethanes, polyureas, polyurethane ionomers, epoxies, polycarbonates, polybutadiene, polyisoprene, and blends thereof. Suitable polymeric materials also include those listed in U.S. Pat. Nos. 6,187,864, 6,232,400, 6,245,862, 6,290,611 and 6,142,887 and in PCT publication no. WO 01/29129.

Flexible material with relatively low specific gravity can also be used as long as nodes 50 are made heavier to achieve a high moment of inertia ball. Alternatively, low specific gravity flexible materials can be used in non-continuous layer 24 in conjunction with a proximate high specific gravity layer. One readily apparent advantage of the invention is that the geodesic or polyhedron screens and perforated shells have an inherent spring-like property that allows the screens and the shells to deform when the ball is struck by a club and to spring back to its original shape after the impact. This property may also improve the CoR and the distance of the ball in addition to the primary function of weight allocation. Another readily apparent advantage of an invention is highly rigid materials, such as certain metals can now be used in a golf ball, because the rigidity of the screens and perforated shells is considerably less than that of a hollow sphere. Suitable metals include, but not limited to, tungsten, steel, titanium, chromium, nickel, copper, aluminum, zinc, magnesium, lead, tin, iron, molybdenum and alloys thereof.

Suitable highly rigid materials include those listed in columns 11, 12 and 17 of U.S. Pat. No. 6,244,977. Fillers with very high specific gravity such as those disclosed in U.S. Pat. No. 6,287,217 at columns 31–32 can also be incorporated into the non-continuous layer. Suitable fillers and composites include, but not limited to, carbon including graphite, glass, aramid, polyester, polyethylene, polypropylene, silicon carbide, boron carbide, natural or synthetic silk.

In accordance to another aspect of the invention, a golf ball may have more than one non-continuous layer as illustrated in FIG. 1. Preferably, intermediate layers 14 and 16 are non-continuous layers arranged adjacent to each other. More preferably, layers 14 and 16 are screens or shells shown, by examples, in FIGS. 4A–4C, 5A–5B and 6. The shells may be the same type or difference type of shells, and preferably the shells are positioned offset to each other, i.e., segments 48 do not completely overlap each other. In accordance to another aspect of the invention, the non-continuous layer is preferably made from a very high specific gravity material in the range of about 1.5 to about 19.0, such that the non-continuous layer can be a thin dense layer, such as thin intermediate layer 34 shown in FIG. 3.

In accordance to another aspect of the invention, a golf ball may have a non-continuous layer and an intermediate layer, such as a continuous layer. For example, one of intermediate layers 14 or 16 may be a non-continuous layer and the other is a continuous layer, or vice versa. Alternatively, the non-continuous layer may be embedded in the continuous layer.

The non-continuous layer 24 may be manufactured by casting, injection molding over the core 22, or by adhering injection or compression molded half-shells to the core by compression molding, laminating, gluing, wrapping, bonding or otherwise affixed to the core. Alternatively, the non-continuous layer 24, such as the geodesic or polyhedron screens shown in FIGS. 4A–4D may be prepared as flat screens with side edges that connect to each other when the flat screen is assembled onto the spherical core. Examples of such side edges include, but not limited to, tongue-and-groove, v-shaped edges, beveled edges or the like. Alternatively, in a preferred embodiment where the non-continuous layer is made from a material with melting temperature higher than those of molten core materials, such as metals, the layer 24 can be cast as an integral preform and be placed in a mold before molten core material is poured or injected into the mold. The molten core material would advantageously flow into the mold through the spaces in the non-continuous layer 24, and encase the layer 24 in situ. A readily apparent advantage of this embodiment is that a relatively large solid core can be realized. Golf balls with a relatively large (1.58 inch or higher) polybutadiene core have exhibited desirable ball properties and flight characteristics. Another advantage is that the integral preform has more structure, since it is made in one-piece, and possesses more resiliency to allow the ball to spring back to its original shape after impact by the golf club.

Alternatively, the non-continuous layer 24 may also comprise discrete portions. The core may be molded with indentations or channels defined thereon. These indentations are sized and dimensioned to receive the discrete portions of the non-continuous layer 24. Examples of discrete, non-continuous layers 24 are shown in FIGS. 7B and 7C.

Additional suitable high specific gravity materials for the intermediate layer 24 and suitable methods such as lamination for assembling intermediate layer 24 on to core 22 are fully disclosed in co-pending patent application entitled "Multi-layered Core Golf Ball" bearing Ser. No. 10/002,641, filed on Nov. 28, 2001, and this application is incorporated herein in its entirety. The disclosed materials and methods are fully adaptable for use with the non-continuous layer 24 of the present invention. More specifically, partially cured layer 24 may be cut into figure-8-shaped or barbell like patterns, similar to a baseball or tennis ball cover. Other patterns such as curved triangles and semi-spheres can also be used. These patterns are laid over an uncured core and then the sub-assembly is cured to lock the non-continuous layer on to the substrate.

As stated above, at least a portion of core 22 may comprise a density reducing filler, or otherwise may have its specific gravity reduced, e.g., by foaming the polymer. The effective specific gravity for this low specific gravity layer is preferably less than 1.1, more preferably less than 1.0 and even more preferably less than 0.9. The actual specific gravity is determined and balanced based upon the specific gravity and physical dimensions of the intermediate layer 24 and the outer core 26.

The low specific gravity layer can be made from a number of suitable materials, so long as the low specific gravity layer is durable, and does not impart undesirable characteristics to the golf ball. Preferably, the low specific gravity layer contributes to the soft compression and resilience of the golf ball. The low specific gravity layer can be made from a thermosetting syntactic foam with hollow sphere fillers or microspheres in a polymeric matrix of epoxy, urethane, polyester or any suitable thermosetting binder, where the cured composition has a specific gravity of less than 1.1 and preferably less than 0.9. Suitable materials may also include a polyurethane foam or an integrally skinned polyurethane foam that forms a solid skin of polyurethane over a foamed substrate of the same composition. Alternatively, suitable materials may also include a nucleated reaction injection molded polyurethane or polyurea, where a gas, typically nitrogen, is essentially whipped into at least one component of the polyurethane, typically, the pre-polymer, prior to component injection into a closed mold where full reaction takes place resulting in a cured polymer having a reduced specific gravity. Furthermore, a cast or RIM polyurethane or polyurea may have its specific gravity further reduced by the addition of fillers or hollow spheres, etc. Additionally, any number of foamed or otherwise specific gravity reduced thermoplastic polymer compositions may also be used such as metallocene-catalyzed polymers and blends thereof described in U.S. Pat. Nos. 5,824,746 and 6,025,442 and in PCT International Publication No. WO 99/52604. Moreover, any materials described as mantle or cover layer materials in U.S. Pat. Nos. 5,919,100, 6,152,834 and 6,149,535 and in PCT International Publication Nos. WO 00/57962 and WO 01/29129 with its specific gravity reduced are suitable materials. Disclosures from these references are hereby incorporated by reference. The low specific gravity layer can also be manufactured by a casting method, sprayed, dipped, injected or compression molded.

Low specific gravity materials that do not have its specific gravity modified are also suitable for core 22. The specific gravity of this layer may also be less than 0.9 and preferably less than 0.8, when materials such as metallocenes, ionomers, or other polyolefinic materials are used. Other suitable materials include polyurethanes, polyurethane ionomers, interpenetrating polymer networks, Hytrel® (polyester-ether elastomer) or Pebax® (polyamide-ester elastomer), etc., which may have specific gravity of less than 1.0. Additionally, suitable unmodified materials are also disclosed in U.S. Pat. Nos. 6,149,535, 6,152,834, 5,919,100, 5,885,172 and WO 00/57962. These references have already been incorporated by reference. The core may also include one or more layers of polybutadiene encased in a layer or layers of polyurethane. The non-reduced specific gravity layer can be manufactured by a casting method, reaction injection molded, injected or compression molded, sprayed or dipped method.

The cover layer 26 is preferably a resilient, non-reduced specific gravity layer. Suitable materials include any material that allows for tailoring of ball compression, coefficient of restitution, spin rate, etc. and are disclosed in U.S. Pat. Nos. 6,419,535, 6,152,834, 5,919,100 and 5,885,172. Ionomers, ionomer blends, thermosetting or thermoplastic polyurethanes, metallocenes are the preferred materials. The cover can be manufactured by a casting method, reaction injection molded, injected or compression molded, sprayed or dipped method.

In accordance to another aspect of the present invention, it has been found that by creating a golf ball with a low spin construction, such as low specific gravity core 22 and non-continuous high specific gravity intermediate layer 24 of ball 20 discussed above, but adding a cover 26 of a thin layer of a relatively soft thermoset material formed from a castable reactive liquid, a golf ball with "progressive performance" from driver to wedge can be formed. As used herein, the term "thermoset" material refers to an irreversible, solid polymer that is the product of the reaction of two or more prepolymer precursor materials.

The thickness of the outer cover layer is important to the "progressive performance" of the golf balls of the present invention. If the outer cover layer is too thick, this cover layer will contribute to the in-flight characteristics related to the overall construction of the ball and not the cover surface properties. However, if the outer cover layer is too thin, it will not be durable enough to withstand repeated impacts by the golfer's clubs. It has been determined that the outer cover layer should have a thickness of less than about 0.05 inch, preferably between about 0.02 and about 0.04 inch. Most preferably, this thickness is about 0.03 inch.

The outer cover layer is formed from a relatively soft thermoset material in order to replicate the soft feel and high spin play characteristics of a balata ball when the balls of the present invention are used for pitch and other "short game" shots. In particular, the outer cover layer should have a Shore D hardness of less than 65 or from about 30 to about 60, preferably 35–50 and most preferably 40–45. Additionally, the materials of the outer cover layer must have a degree of abrasion resistance in order to be suitable for use as a golf ball cover. The outer cover layer of the present invention can comprise any suitable thermoset material which is formed from a castable reactive liquid material. The preferred materials for the outer cover layer include, but are not limited to, thermoset urethanes and polyurethanes, thermoset urethane ionomers and thermoset urethane epoxies. Examples of suitable polyurethane ionomers are disclosed in U.S. Pat. No. 5,692,974 entitled "Golf Ball Covers," the disclosure of which is hereby incorporated by reference in its entirety in the present application.

Thermoset polyurethanes and urethanes are particularly preferred for the outer cover layers of the balls of the present invention. Polyurethane is a product of a reaction between a polyurethane prepolymer and a curing agent. The polyurethane prepolymer is a product formed by a reaction between a polyol and a diisocyanate. The curing agent is typically either a diamine or glycol. Often a catalyst is employed to promote the reaction between the curing agent and the polyurethane prepolymer.

Conventionally, thermoset polyurethanes are prepared using a diisocyanate, such as 2,4-toluene diisocyanate (TDI) or methylenebis-(4-cyclohexyl isocyanate) (HMDI) and a polyol which is cured with a polyamine, such as methylenedianiline (MDA), or a trifunctional glycol, such as trimethylol propane, or tetrafunctional glycol, such as N,N,N',N'-tetrakis(2-hydroxpropyl)ethylenediamine. However, the present invention is not limited to just these specific types of thermoset polyurethanes. Quite to the contrary, any suitable thermoset polyurethane may be employed to form the outer cover layer of the present invention.

By way of example, ball 30 is a progressive performance, low initial spin rate ball in accordance to the present invention comprising core 32 and thin dense layer 34 and cover 36. Preferably, thin dense non-continuous layer 34 is located proximate to outer cover 36, and preferably layer 34 is made as thin as possible. Layer 34 may have a thickness from about 0.001 inch to about 0.05 inch (0.025 mm to 1.27 mm), more preferably from about 0.005 inch to about 0.030 inch (0.127 mm to 0.762 mm), and most preferably from about 0.010 inch to about 0.020 inch (0.254 mm to 0.508 mm). Thin dense non-continuous layer 34 preferably has a specific gravity of greater than 1.2, more preferably more than 1.5, even more preferably more than 1.8 and most preferably more than 2.0. Preferably, thin dense layer non-continuous 34 is located as close as possible to the outer surface of ball 30, i.e, the land surface or the un-dimpled surface of cover 36. For golf ball having a cover thickness of about 0.030 inch (0.76 mm), the thin dense layer would be located from 0.031 inch to about 0.070 inch (0.79 mm to 1.78 mm) from the land surface including the thickness of the thin dense layer, well outside the centroid radius discussed above. For a golf ball having a cover thickness (one or more layers of the same or different material) of about 0.110 inch (2.8 mm), the thin dense layer would be located from about 0.111 inch to about 0.151 inch (2.82 mm to 3.84 mm) from the land surface, also outside the centroid radius. The advantages of locating the thin dense layer as radially outward as possible have been discussed in detail in the parent application Ser. No. 09/815,753. It is, however, necessary to locate the thin dense layer outside of the centroid radius. Except for the moment of inertia, the presence of the thin dense layer preferably does not appreciably affect the overall ball properties, such as the feel, compression, coefficient of restitution, and cover hardness.

Cover 36 of ball 30, as discussed above, is made from a thermoset polyurethane, with a Shore D Hardness of less than 65, more preferably from about 30 to about 60, more preferably from about 35 to about 50 and most preferably from about 40 to about 45. The thickness of cover 36 is preferably less than 0.05 inch (1.27 mm), more preferably between about 0.02 inch to 0.04 inch (0.51 mm to 1.02 mm), and most preferably about 0.03 inch (0.76 mm). Core 32 is preferably made from a foamed polymer, such as polybutadiene. Preferably, the core 32 has a diameter from 39 mm to 42 mm (about 1.54 inch to 1.64 inch) and more preferably from 40 mm to 42 mm (1.56 inch to 1.64 inch). The core has a PGA compression of preferably less than 90, more preferably less than 80 and most preferably less than 70.

Compression is measured by applying a spring-loaded force to the golf ball center, golf ball core or the golf ball to be examined, with a manual instrument (an "Atti gauge") manufactured by the Atti Engineering company of Union City, N.J. This machine, equipped with a Federal Dial Gauge, Model D81-C, employs a calibrated spring under a known load. The sphere to be tested is forced a distance of 0.2 inch (5 mm) against this spring. If the spring, in turn, compresses 0.2 inch, the compression is rated at 100; if the spring compresses 0.1 inch, the compression value is rated as 0. Thus more compressible, softer materials will have lower Atti gauge values than harder, less compressible materials. Compression measured with this instrument is also referred to as PGA compression.

As stated above, the moment of inertia for a 1.62 oz and 1.68 inch golf ball with evenly distributed weight through any diameter is 0.4572 oz·inch$^2$. Hence, moments of inertia higher than about 0.46 oz·inch$^2$ would be considered as a high moment of inertia ball. As shown above, ball 30 having a thin dense layer 34, which is positioned at about 0.040 inch from the outer surface of ball 30 (or 0.800 inch from the center), has the following moments of inertia.

| Weight (oz) of Thin Dense Layer | Moment of Inertia (oz · inch$^2$) |
|---|---|
| 0.20 | 0.4861 |
| 0.405 | 0.5157 |
| 0.81 | 0.5742 |
| 1.61 | 0.6898 |

More preferably, for a high moment of inertia ball the moment of inertia is greater than 0.50 oz·in$^2$ and even more preferably greater than 0.575 oz·in$^2$.

While various descriptions of the present invention are described above, it is understood that the various features of the present invention can be used singly or in combination thereof. Therefore, this invention is not to be limited to the specifically preferred embodiments depicted therein.

What is claimed is:

1. A golf ball comprising a thin dense layer encasing a core, wherein the thin dense layer is encased by a cover, the thin dense layer is comprised of a fully neutralized jonomer and has an inner diameter of at least 38.4 mm, has a specific gravity of greater than 1.2, has a thickness from 0.025 mm to 1.27 mm and is positioned at a distance of less than 4.83 rein from the surface of the ball, wherein the thin dense layer is a non-continuous layer.

2. The golf ball of claim 1, wherein the non-continuous layer is formed of a material that further comprises a polyolefin.

3. The golf ball of claim 1, wherein the non-continuous layer is formed of a material that further comprises a coplymier of polyethylene and an acrylic or methacrylic acid.

4. The golf ball of claim 3, wherein the non-continuous layer comprises a terpolymer of ethylene, a softening acrylate class ester selected from the group of methyl acrylate, n-butyl-acrylate and iso-butyl-acrylate, and a unsaturated carboxylic acid selected from the group of acrylic acid and methacrylic acid.

5. The golf ball of claim 1, wherein the non-continuous layer is further comprised of a material selected from a group consisting of metallocene catalyzed polyolefins, polyesters, polyamides, non-ionomeric thermoplastic elastomers, copolyether-esters, copolyether-amides, thermoplastic or thermosetting polyurethanes, polyureas, polyurethane ionomers, epoxies, polycarbonates, polybutadiene, polyisoprene, and blends thereof.

6. The golf ball of claim 1, wherein the non-continuous layer further comprises fibers.

7. The golf ball of claim 6, wherein the fibers are selected from a group consisting of carbon graphite, glass, araniid, polyester, polyethylene, polypropylene, silicon carbide, boron carbide, natural and synthetic silk.

8. The golf ball of claim 1, wherein the cover has a Shore D hardness of less than about 65.

9. The golf ball of claim 8, wherein the cover has a Shore D hardness of between about 30 and about 60.

10. The golf ball of claim 9, wherein the cover has a Shore D hardness of between about 35 and about 50.

11. The golf ball of claim 10, wherein the cover has a Shore D hardness of between about 40 and about 45.

12. The golf ball of claim 1, wherein the specific gravity of the non-continuous layer is greater than 1.5.

13. The golf ball of claim 12, wherein the specific gravity of the non-continuous layer is greater than 1.8.

14. The golf ball of claim 13, wherein the specific gravity of the non-continuous layer is greater than 2.0.

15. The golf ball of claim 1, wherein the thickness of the non-continuous layer is from 0.127 mm to 0.76 mm.

16. The golf ball of claim 15, wherein the thickness of the non-continuous layer is from 0.25 mm to 0.5 mm.

17. The golf ball of claim 1, wherein the core has a specific gravity of less than 1.0.

18. The golf ball of claim 1, wherein the core has a specific gravity of less than 0.9.

19. The golf ball of claim 1, wherein the core is made from a foamed material.

* * * * *